US005913323A

United States Patent [19]

Hudelmaier

[11] Patent Number: 5,913,323

[45] Date of Patent: Jun. 22, 1999

[54] DEVICE AND METHOD FOR PUMPING CONCRETE

[76] Inventor: Gerhard Hudelmaier, Sylvanerweg 19, Ulm, Germany, 89075

[21] Appl. No.: 08/678,469

[22] PCT Filed: Nov. 8, 1995

[86] PCT No.: PCT/EP95/04400

§ 371 Date: Oct. 10, 1996

§ 102(e) Date: Oct. 10, 1996

[87] PCT Pub. No.: WO96/14485

PCT Pub. Date: May 17, 1996

[30] Foreign Application Priority Data

Nov. 8, 1994 [DE] Germany ..... 4439930

[51] Int. Cl.[6] ..... B67D 5/64

[52] U.S. Cl. ..... 137/1; 137/615; 285/320

[58] Field of Search ..... 137/615, 1; 141/387; 285/320

[56] References Cited

U.S. PATENT DOCUMENTS

| | | | |
|---|---|---|---|
| 3,150,753 | 9/1964 | Ivanyi . | |
| 3,707,990 | 1/1973 | Schaible et al. | 137/615 |
| 4,130,134 | 12/1978 | Castle . | |
| 4,828,033 | 5/1989 | Frison | 137/615 X |
| 5,535,780 | 7/1996 | Schlecht et al. | 137/615 |

FOREIGN PATENT DOCUMENTS

| | | |
|---|---|---|
| A-1949826 | 4/1971 | Germany . |
| A-3409474 | 9/1985 | Germany . |
| U-9102678 | 5/1991 | Germany . |
| U-9212417 | 1/1993 | Germany . |
| A-1085273 | 9/1967 | United Kingdom . |
| A-1151173 | 5/1969 | United Kingdom . |

*Primary Examiner*—Kevin Lee
*Attorney, Agent, or Firm*—Nilles & Nilles SC

[57] ABSTRACT

A device and method for pumping concrete, comprising a supporting arm projecting at an operating position and used for positioning the conduit end of a pump conduit, the supporting arm including supporting arm segments which each have arranged thereon at least one tubular segment constituting a component of the pump conduit. In order to achieve a higher lift, device provides the features that at least one of the supporting arm segments is adapted to be telescoped and can be transferred from a non-extended starting position to at least one extended position at which the length of the telescopic supporting arm segment is longer than the length of the respective associated tubular segment, that there is provided at least one positioning arm for positioning at least one auxiliary tubular segment, said positioning arm being adapted to be transferred from a first position at which the auxiliary tubular segment is arranged outside the volume taken up by the tubular segments to a second position at which at least one end section of said auxiliary tubular segment is in alignment with at least one end section of one of said tubular segments, and that the pump conduit is adapted to be formed essentially by the tubular segments and the auxiliary tubular segment.

37 Claims, 8 Drawing Sheets

DEVICE AND METHOD FOR PUMPING CONCRETE

BACKGROUND OF THE INVENTION

The present invention refers to a device for pumping concrete, comprising a supporting arm projecting at an operating position and used for positioning the conduit end of a pump conduit, said supporting arm including supporting arm segments which each have arranged thereon at least one tubular segment constituting a component of said pump conduit Such devices for pumping concrete are known in practice. They are used e.g. in construction engineering, especially for producing multistoreyed buildings, bridges and the like, where it is necessary to convey large amounts of concrete onto a high level within a short period of time. Such devices are in most cases mounted on chassis of trucks and, at the operating position, they permit lifts of approx. 40 m. Due to the fact that the supporting arm is subdivided into supporting arm segments, said supporting arm can be disassembled or folded for the purpose of transport Weight limitations and limitations in the admissible dimensions make it, however, impossible to use devices of the type mentioned at the beginning which achieve higher lifts. This limits the possible field of use of said device.

SUMMARY OF THE INVENTION

Hence, it is the object of the present invention to provide a device or the type mentioned at the beginning which has an enlarged field of use in comparison with conventional devices for pumping concrete.

In accordance with the present invention, this object is achieved by the features that at least one of said supporting arm segments is adapted to be telescoped and can be transferred from a non-extended starting position to at least one extended position at which the length of said telescopic supporting arm segment is longer than the length of the respective associated tubular segments, that there is provided at least one positioning means for positioning at least one auxiliary tubular segment, said positioning means being adapted to be transferred from a first position at which the auxiliary tubular segment is arranged outside the volume taken up by the tubular segments to a second position at which at least one end section of said auxiliary tubular segment is in alignment with at least one end section of one of said tubular segments, and that the pump conduit is adapted to be formed essentially by the tubular segments and the auxiliary tubular segment.

The solution is simple and it makes it possible to provide a device for pumping concrete by means of which the same lift as in the case of conventional devices for pumping concrete can be achieved on the basis of smaller dimensions, or lifts which are higher than those obtained up to now can be achieved on the basis of dimensions which are essentially identical to those of conventional devices.

In accordance with the present invention, a separation point can additionally be arranged at least between two tubular segments so that at one of the extended positions of the telescopic supporting arm segment the end sections of the associated tubular segments, which define the separation point, are spaced from one another in such a way that the auxiliary tubular segment is adapted to be positioned between said end sections defining the separation point. In this way, the auxiliary tubular segment can be inserted between two tubular segments.

In accordance with an advantageous further development of the present invention, an end section of the auxiliary tubular segment can always be positioned essentially on one level with an end section of a tubular segment in the axial direction of the associated end section. The movements required for inserting the auxiliary tubular segment between two tubular segments can be reduced in this way.

A particularly economy-priced solution is obtained when the positioning means is constructed as a movable holder for the auxiliary tubular segment. In addition, it will be advantageous when the positioning means is constructed as a pivotable holder for the auxiliary tubular segment.

A particularly compact device will be obtained when the holder is arranged on one of the segments. The holder can be arranged on the telescopic segment.

In a first embodiment, it can be advantageous when the longitudinal axis of the auxiliary tubular segment extends essentially parallel to the longitudinal direction of the telescopic segment. It is thus possible to reduce the number of movements which are necessary for positioning the auxiliary tubular segment between two tubular segments. In this connection, it may prove to be advantageous when the pivot axis of the holder extends essentially parallel to the longitudinal direction of the telescopic supporting arm segment. This permits the auxiliary tubular segment to be positioned between the two tubular segments by means of a simple pivotal movement.

In a second embodiment, the pivot axis of the holder can extend essentially at right angles to the longitudinal direction of the telescopic supporting arm segment and the holder can be arranged such that it is adapted to be displaced essentially transversely to the longitudinal direction of the telescopic supporting arm segment. In the case of this embodiment, the auxiliary tubular segment can be positioned by simple tilting and by a longitudinal displacement between two tubular segments.

In the case of both embodiments, it will be advantageous when the end sections of the tubular segments, which define the separation point, are adapted to be fitted into one another. When said end sections are fitted into one another, a stable connection between the tubular segments is obtained. For the same reason, it is advantageous when the respective end sections of the tubular segments and of the auxiliary tubular segment are adapted to be fitted into one another. A particularly economy-priced solution for connecting the auxiliary tubular segment to at least one of the tubular segments will be obtained when the auxiliary tubular segment is supported in the holder such that it is adapted to be displaced to a limited degree in the axial direction.

In accordance with an advantageous further development of the present invention, the holder can be provided with a spring which pretensions the auxiliary tubular segment in a direction opposite to the telescoping direction when the telescopic supporting arm segment is being transferred from its non-extended position to one of its extended positions. In this way, a tubular segment and the auxiliary tubular segment can be separated rapidly and effectively. In order to simplify the process of connecting the auxiliary tubular segment and the tubular segment, a drive can be provided by means of which the auxiliary tubular segment can be moved against the force applied by the spring. In this connection, it may prove advantageous to provide a telescope drive by means of which the telescopic segment can be transferred from its non-extended position to its extended position and back to said non-extended position, whereby the structural design of the device can be simplified. In this respect, it may prove to be particularly advantageous when the telescope drive constitutes the drive for the auxiliary tubular segment.

In accordance with an advantageous further development of the present invention, the end sections defining the separation point can be adapted to be connected with the aid of quick-acting coupling means. It may turn out to be advantageous when the respective end sections of the tubular segments and the associated end sections of the auxiliary tubular segment are adapted to be connected with the aid of quick-acting coupling means. The structural design of the device can essentially be simplified in this way.

In this connection, it may be advantageous when the end sections provided with the quick-acting coupling means are constructed as a claw clutch, one end section being provided with pivotably supported claws, which are adapted to be transferred from a closed position at which said claws engage behind a shoulder of the respective other, associated end section, thus interconnecting the two end sections, to an open position at which the claws release said shoulder and the end sections can be separated from one another. In accordance with an advantageous embodiment, the claws can he spring-loaded and pretensioned by the springs at their closed position. In order to make the claw clutch suitable for remote control, the spring-loaded claws can be adapted to be transferred from their closed position to their open position with the aid of fluid means, preferably with the aid of hydraulic means, in accordance with an advantageous further development of the present invention.

For achieving a tight connection between tubular segments or between tubular segments and auxiliary tubular segments, the end face of at least one of said end sections can be provided with an annular recess accommodating, in the interengaged condition of the tubular segments, a projection having the shape of a cylindrical ring. In addition, the annular recess can have arranged therein a sealing element, which has the shape of a cylindrical ring and on which the end face of said projection having the shape of a cylindrical ring rests in such a way that the two end sections are connected in a liquid-tight manner.

In the case of an advantageous further development of the present invention, the supporting arm segments can be articulated on one another by means of joints. The supporting arm can thus be constructed such that it is adapted to be folded together. In this respect, it may be advantageous when the tubular segments are articulated on one another in the area of said joints.

For the purpose of transporting the device, it may be advantageous when the supporting arm segments are adapted to be transferred to a transport position at which they are arranged essentially parallel to one another. The supporting arm segments can be arranged one on top of the other at said transport position.

In order to achieve even higher lifts, several telescopic supporting arm segments and several positioning means can be provided.

In accordance with an advantageous embodiment of the present invention, the tubular segments can be secured to the associated supporting arm segments. In this connection, the telescopic supporting arm segment can comprise an extendable subsegment and a fixed subsegment, the tubular segment being attached to the extendable subsegment which is displaceably received in said fixed subsegment. It is also imaginable that the tubular segment is attached to the fixed subsegment.

For the purpose of transporting the device, it will be advantageous when the concrete pump is arranged on a chassis. A particular advantage can be achieved, when the device is mounted on the chassis of a truck.

The present invention additionally provides the feature that the end of the pump conduit can be provided with a hoselike extension for distributing the pumped concrete.

For operating the device for pumping concrete, the present invention provides the features that the telescopic segment is transferred to its extended position and that, subsequently, the positioning means is transferred from its position of rest to is operating position.

In addition, the end sections of the tubular segments and the associated end sections of the auxiliary tubular segment can be fitted into one another.

Furthermore, it will be advantageous when, for fitting the end sections of the tubular segments and the associated end sections of the auxiliary tubular segment into one another, the extended segment is returned from a further extended first telescoped position to a less extended second telescoped position at which the end sections of the tubular segments and the associated and sections of the auxiliary tubular segment are fitted into one another.

In the following, the mode of operation of the present invention will be explained in detail on the basis of an embodiment.

DETAILED DESCRIPTION OF THE PREFERRED EMBODIMENTS

Figure 1:
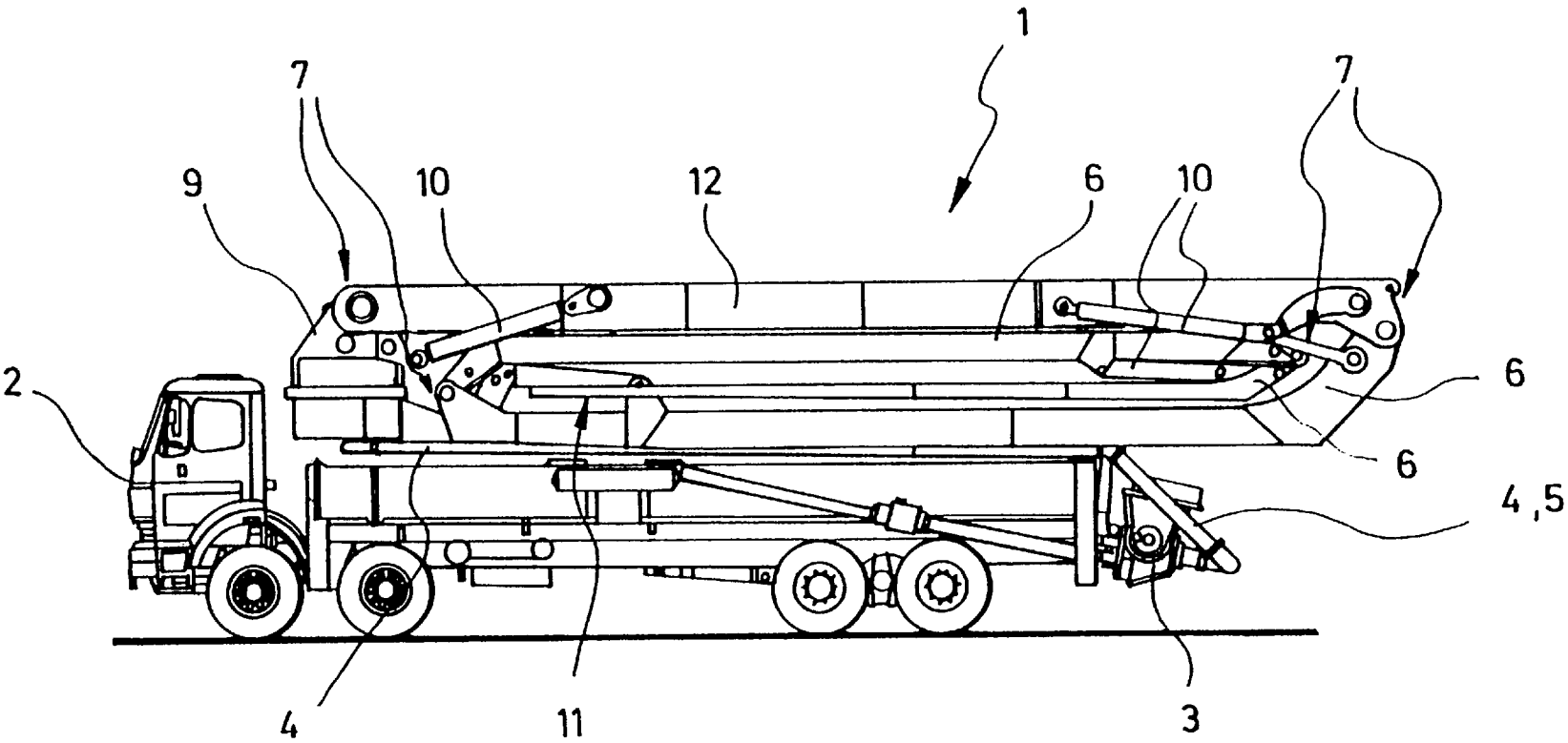
FIG. 1 shows the device for pumping concrete according to the present invention at a transport position on a truck.

FIG. 1 shows the device 1 for pumping concrete, which is fixedly mounted on the chassis 2 of a truck. At the rear part of said chassis 2, a pump drive 3 is provided. Tubular segments 4 extend from said pump drive 3 and form in combination a pump conduit 5.

The respective tubular segments 4 are secured to supporting arm segments 6. The respective supporting arm segments 6 are articulated on one another by means of joints 7, and also the tubular segments 4 are articulated on one another via said joints 7.

Figure 3:
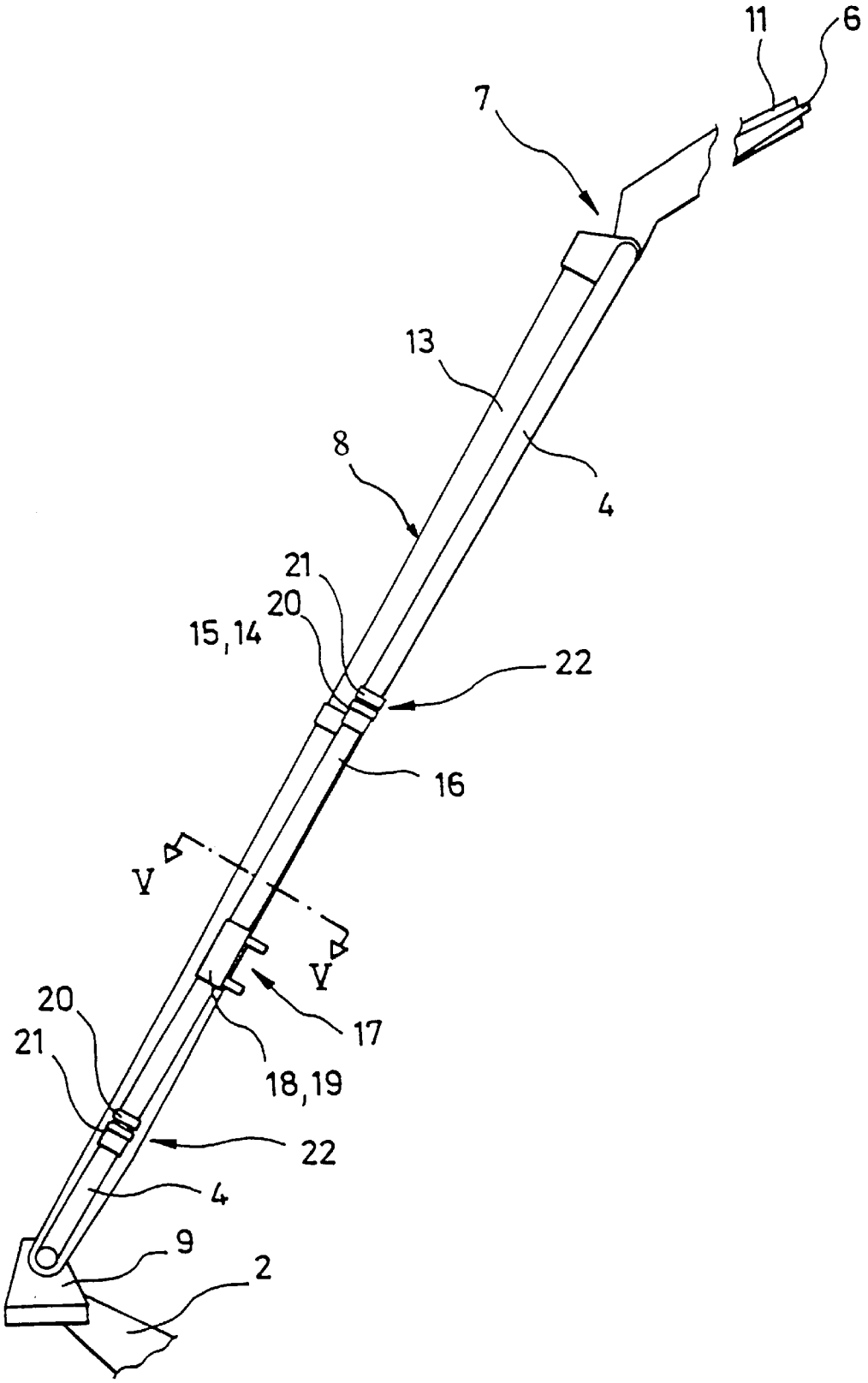
FIG. 3 shows the telescopic supporting arm segment according to FIG. 2 at an extended position.
Figure 4:
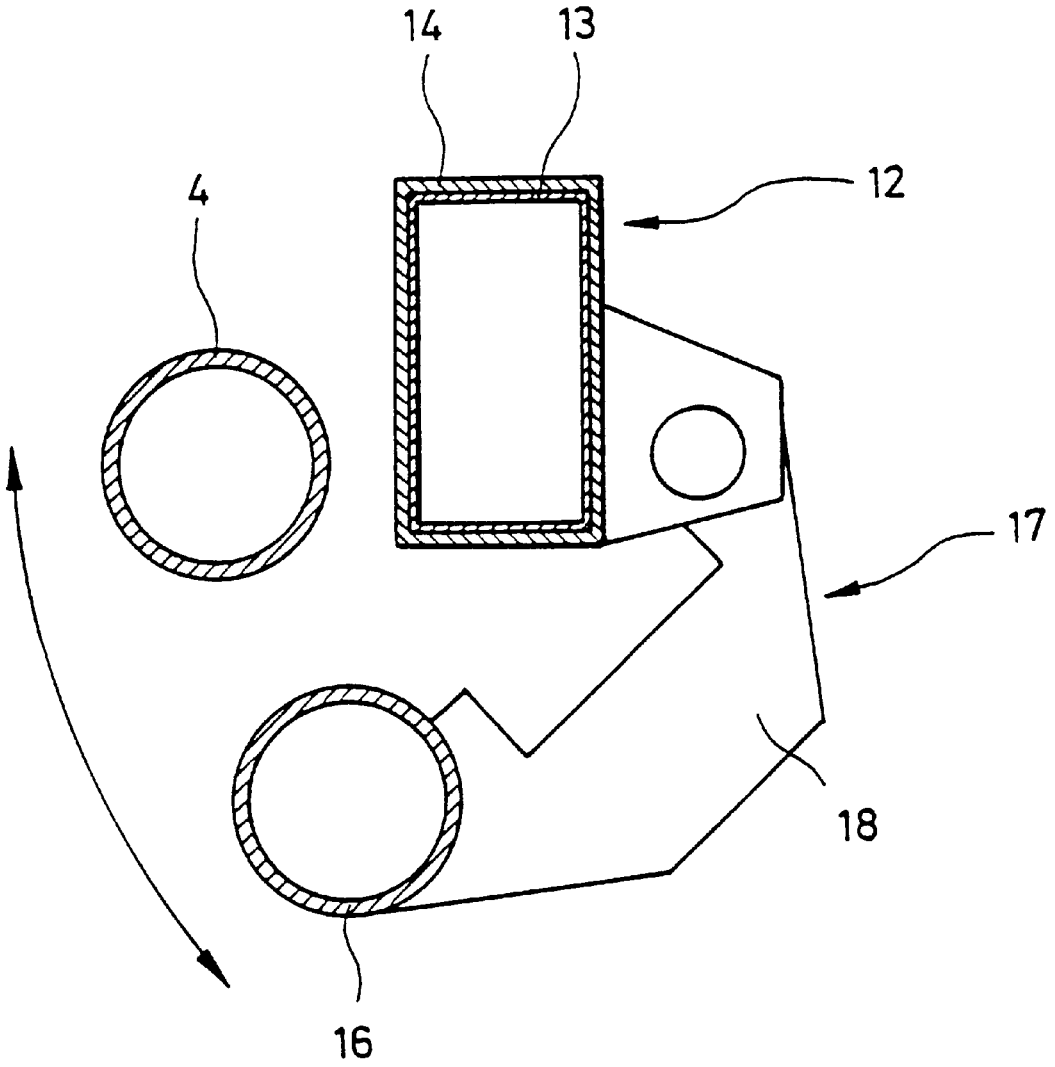
FIG. 4 shows a sectional view of the supporting arm segment according to FIG. 2 along the line IV—IV.
Figure 5:
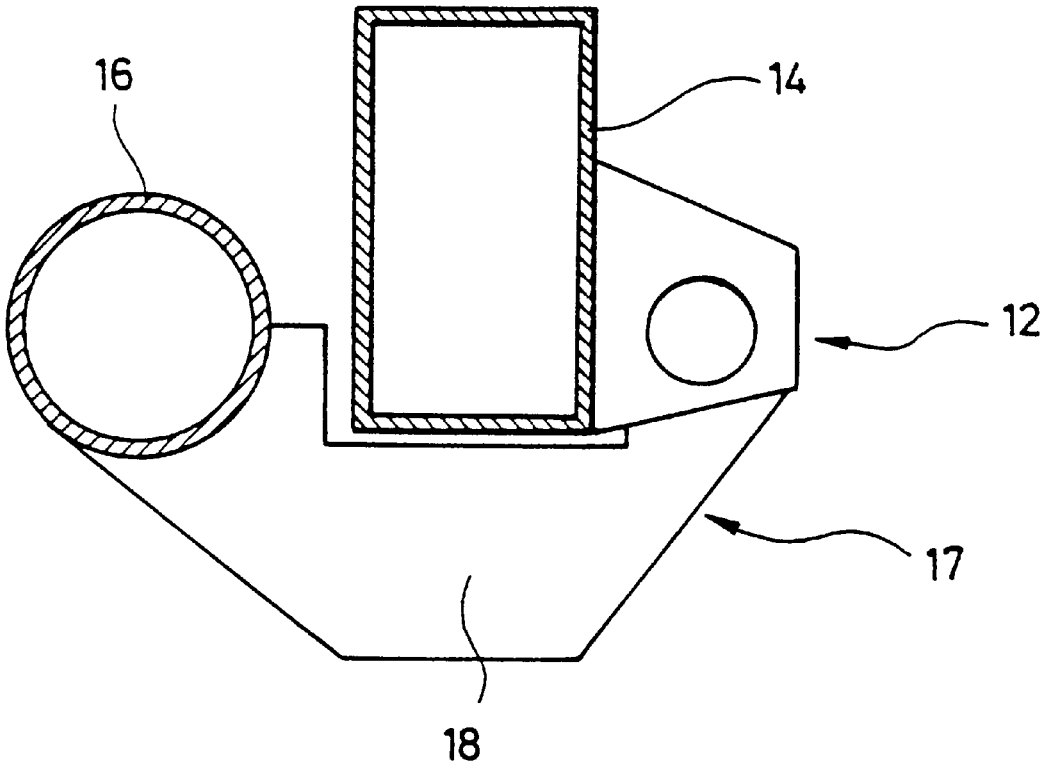
FIG. 5 shows a sectional view of the supporting arm segment according to FIG. 3 along the line V—V.

As can be seen in FIG. 1, the supporting arm segments 6 are folded onto one another for transporting the device 1. At an operating position, the supporting arm segments 6 form a projecting supporting arm 8 as seen in FIG. 3, which is supported on the truck chassis 2 via a pivot joint 9 such that it is adapted to be rotated about a vertical axis. The supporting arm 8 is transferred from its transport position to its operating position by means of several hydraulic cylinders 10. When the device 1 is at its operating position, one conduit end 11 in the pump conduit 5 is located at the end of the supporting arm segment 6 projecting furthest.

One of the supporting arm segments 6 is a telescopic supporting arm segment 7 comprising an extendable subsegment 13 and a fixed subsegment 14. The extendable subsegment 13 is supported in said fixed subsegment such that it is adapted to be telescopically extended in the axial direction. Telescoping of the telescopic supporting arm segment 12 is effected via a hydraulic telescope drive 15 which is not shown.

Figure 2:
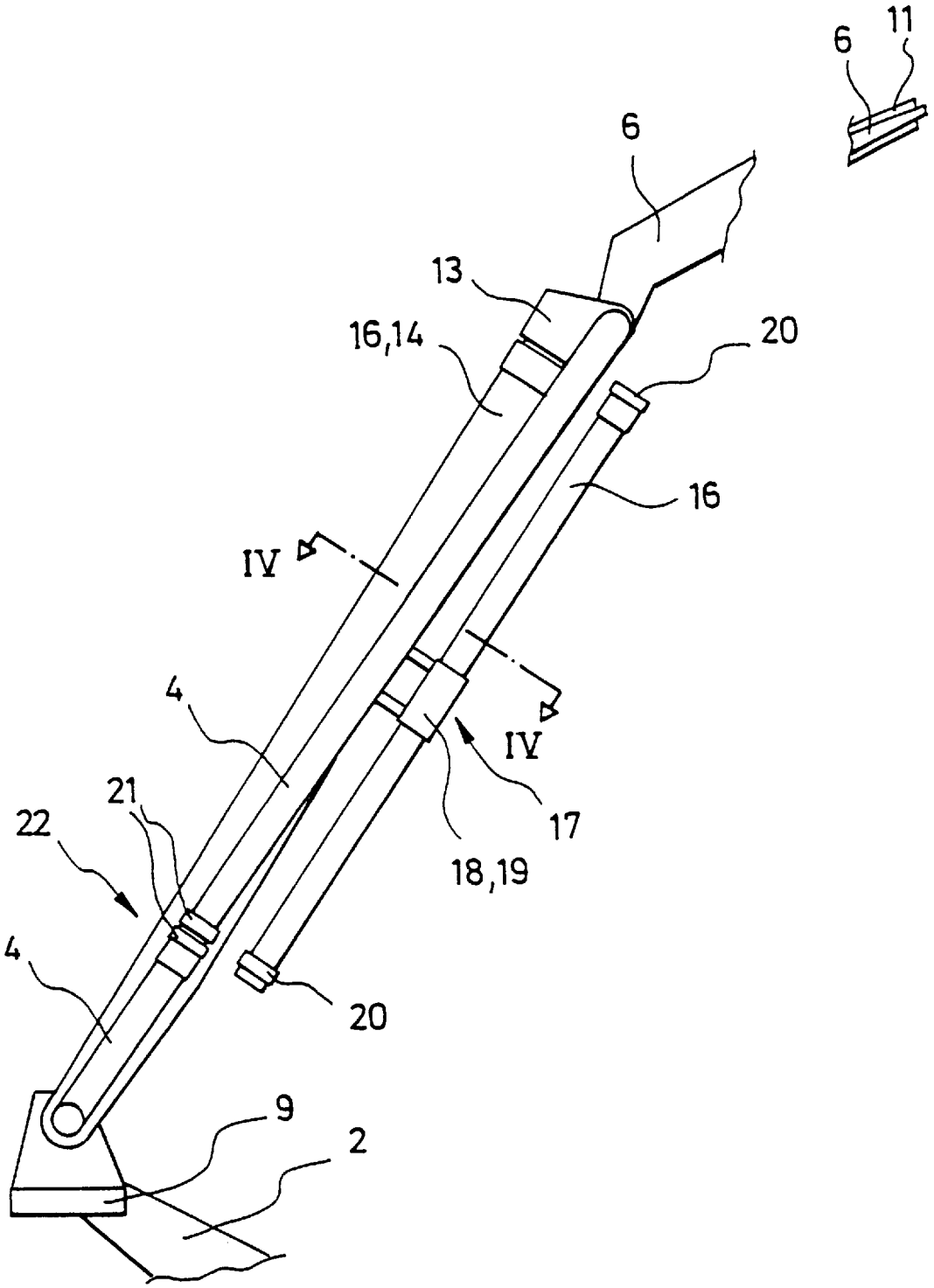
FIG. 2 shows a side view of a first embodiment of a telescopic supporting arm segment of the device according to FIG. 1 at the non-extended position.
Figure 6:
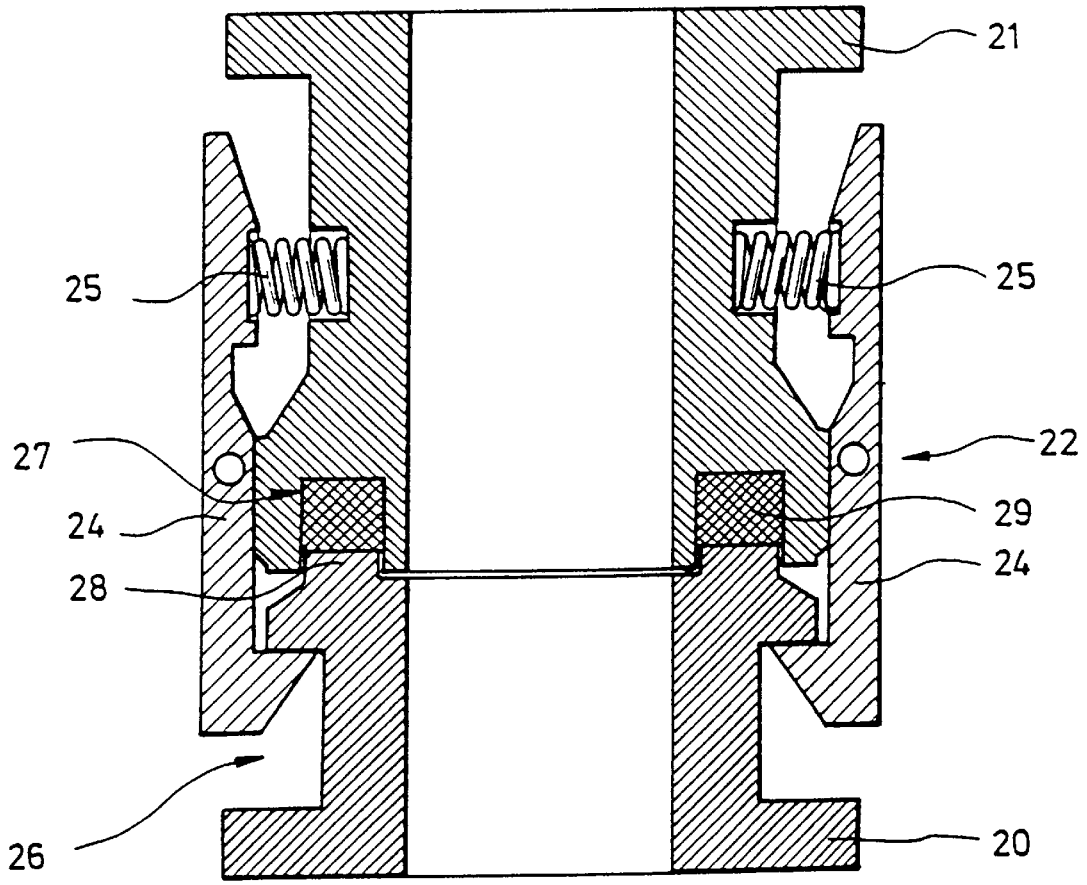
FIG. 6 shows a sectional side view of a separation point between a tubular segment and an auxiliary tubular segment.

As can be seen from FIG. 2, an auxiliary tubular segment 16 extends parallel to the tubular segment 4 of the telescopic supporting arm segment 12. This auxiliary tubular segment 16 is held by a positioning means 17 which is attached to the telescopic supporting arm segment 12. The positioning means 17 is provided with a holder 18 which is adapted to be pivoted about an axis of rotation extending parallel to the longitudinal direction of the telescopic supporting arm segment 12. In the holder 18, the auxiliary tubular segment 16 is supported such that it is adapted to be displaced to a limited degree in the direction of its longitudinal axis. A spring 19 (not shown) in the holder 18 pretensions the auxiliary tubular segment 16 in the direction of the telescoping operation when the telescopic supporting arm segment 12 is being transferred from its non-extended starting position to its telescopic position. The holder 18 is adapted to be transferred from a first position at which the auxiliary tubular segment 16 is not aligned with the tubular segments 4 to a second position where at least one end section 20 of the auxiliary tubular segment 16 is in alignment with at least one end section 21 of one of the tubular segments 4. FIG. 3 shows the holder 18 at its second position. Furthermore, it can also be inferred from FIG. 2 and 3 that, in the longitudinal direction of the of the telescopic supporting arm segment 12, an end section 20 of the auxiliary tubular segment 16 is always arranged essentially on one level with one of the end sections 21 of the tubular segments 4. FIG. 2 and 3 additionally disclose that a separation point 22 is provided between the tubular segments 4 arranged close to the auxiliary tubular segment 16. At this separation point 22, the end sections 21 of the associated tubular segments 4 are releasably connected by a claw clutch 23. In FIG. 6, the claw clutch 23 is shown in a sectional side view. As can be seen from FIG. 6, one of the end sections 21 of the tubular segments 4 is provided with pivotably supported claws 24, which are adapted to be transferred from a closed position to an open position, the claws 24 being pretensioned by springs 25 at their closed position. At said closed position, said claws 24 engage behind a shoulder 26 of the respective other end section 21 of the associated tubular segment 4. In addition, it can be seen that one of the end sections 21 of the tubular segments 4 is provided with an annular recess 27 in the end face thereof; in the interengaged condition of the tubular segments 4, a cylindrical projection 28 is received in said recess 27. Said annular recess has additionally provided therein a sealing element 29, which has the shape of a cylindrical ring and on which the end face of said projection having the shape of a cylindrical ring rests. This has the effect that, in the interengaged condition, the tubular segments 4 are interconnected in a liquid-tight manner. The claws 24 are adapted to be hydraulically actuated by means of a hydraulic device 30, which is not shown.

The end sections 20 of the auxiliary tubular segment 16 have a structural design which is complementary to the structural design of the claw clutch 23 in such a way that the auxiliary tubular segment 16 can be inserted between two associated end sections 20 of the tubular segments 4 and coupled.

As can be seen from FIG. 3, the telescopic supporting arm segment 12 can be transferred to a telescopic position at which the auxiliary tubular segment 16 is positioned between the tubular segment 4 attached to the extendable subsegment 13 and the tubular segment 4 attached to the fixed subsegment 14. The telescopic supporting arm segment 12 can be arrested at a plurality of extended positions.

In the case of a second embodiment of the device 1 according to the present invention, the auxiliary tubular segment 16 is supported in the positioning means 17 such that it is adapted to be pivoted about an axis at right angles to the longitudinal direction of the telescopic supporting arm segment 12. The positioning means 17 additionally permits the auxiliary tubular segment 16 to be displaced at right angles to the longitudinal direction of the telescopic supporting arm segment 12.

In the following, the mode of operation of the device according to the present invention will be explained in detail:

When the device 1 according to the present invention is being transferred from its transport position to its operating position, the supporting arm segments 6 and 12, which are folded onto one another at the transport position, are unfolded such that they define a projecting supporting arm 8. Subsequently, the telescopic supporting arm segment 12 is transferred from its non-extended starting position to an extended position, the first step of the transfer being that the tubular segments 4 are separated by the claw clutch 23 at the separation point 22. Due to the fact that one of the tubular segments 4 is attached to the extendable subsegment 13, the tubular segments 4, which were previously interconnected at the separation point 22, are moved to spaced-apart positions when the telescopic supporting arm segment 12 is being transferred to an extended position. Said position is a first extended position at which the distance between the two spaced tubular segments 4 is larger than the length of the auxiliary tubular segment 16.

The auxiliary tubular segment 16 is now positioned between the two end sections 21 of the two spaced tubular segments 4 with the aid of the positioning means 17. For this purpose, the holder 18 is transferred from its first position to its second position at which the end sections 20 of the auxiliary tubular segment 16 are in alignment with the end sections 21 of the spaced tubular segments 4. Subsequently, the extended supporting arm segment 12 is transferred to a second extended position at which the distance between the two end sections 21 of the spaced tubular segments 4 is smaller than the distance between the end sections 20 of the auxiliary tubular segment 16, whereby the spaced tubular segments 4 and the auxiliary tubular segment 16 are fitted into one another. In the course of this process, the auxiliary tubular segment 16 is pressed, against the force applied by spring 19 (not shown), into the tubular segment 4, which is attached to the fixed subsegment 14, by the pressure applied by the tubular segment 4 attached to the extendable subsegment 13. In view of the fact that the end sections of the auxiliary tubular segment as well as those of the tubular segments 4 have identical structural designs, also the respective interconnected end sections 20 and 21 of the auxiliary tubular segment 16 and of the tubular segments 4 define claw clutches.

Figure 7:
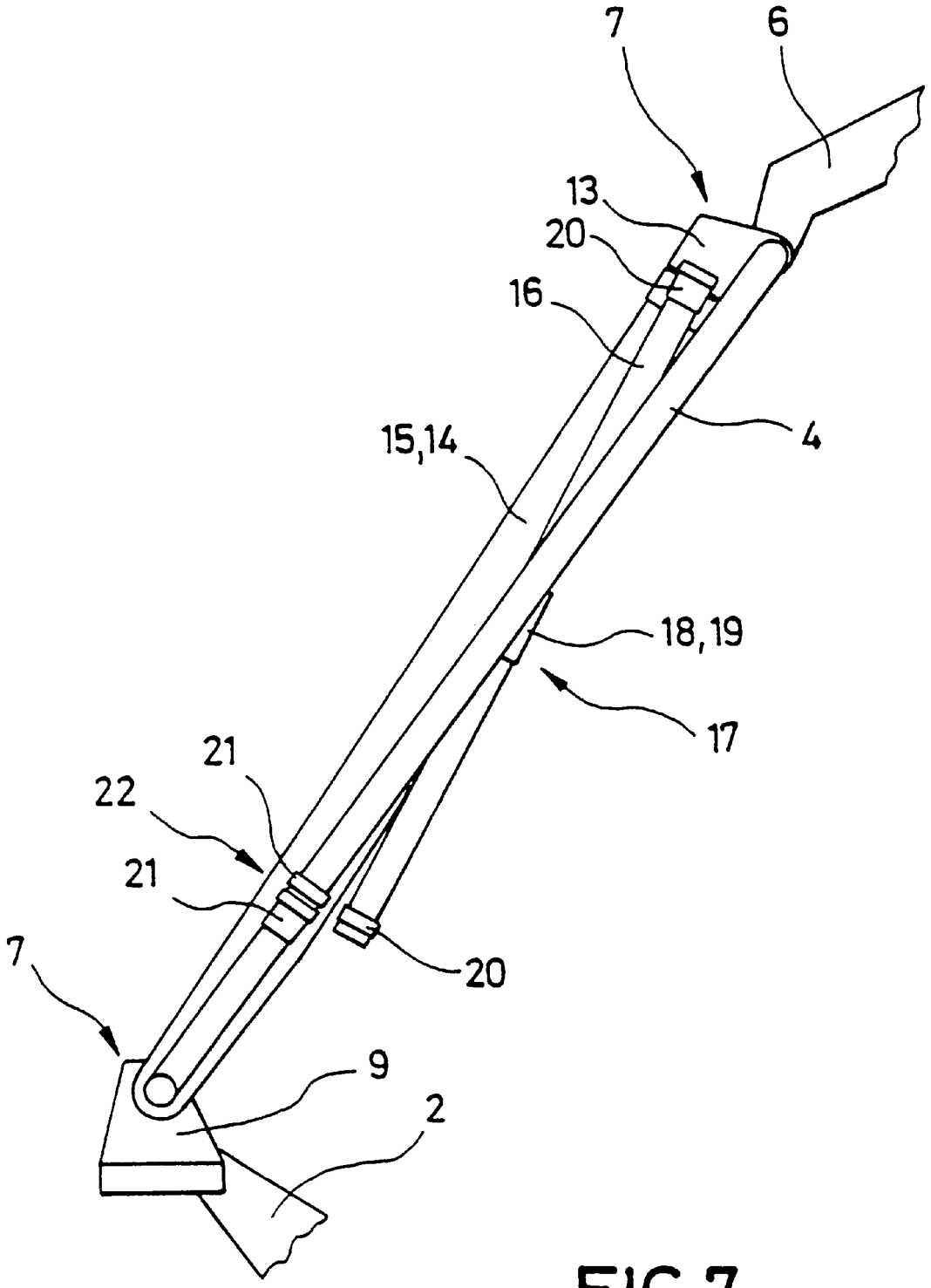
FIG. 7 shows a second embodiment of a telescopic supporting arm segment at a non-extended position.
Figure 8:
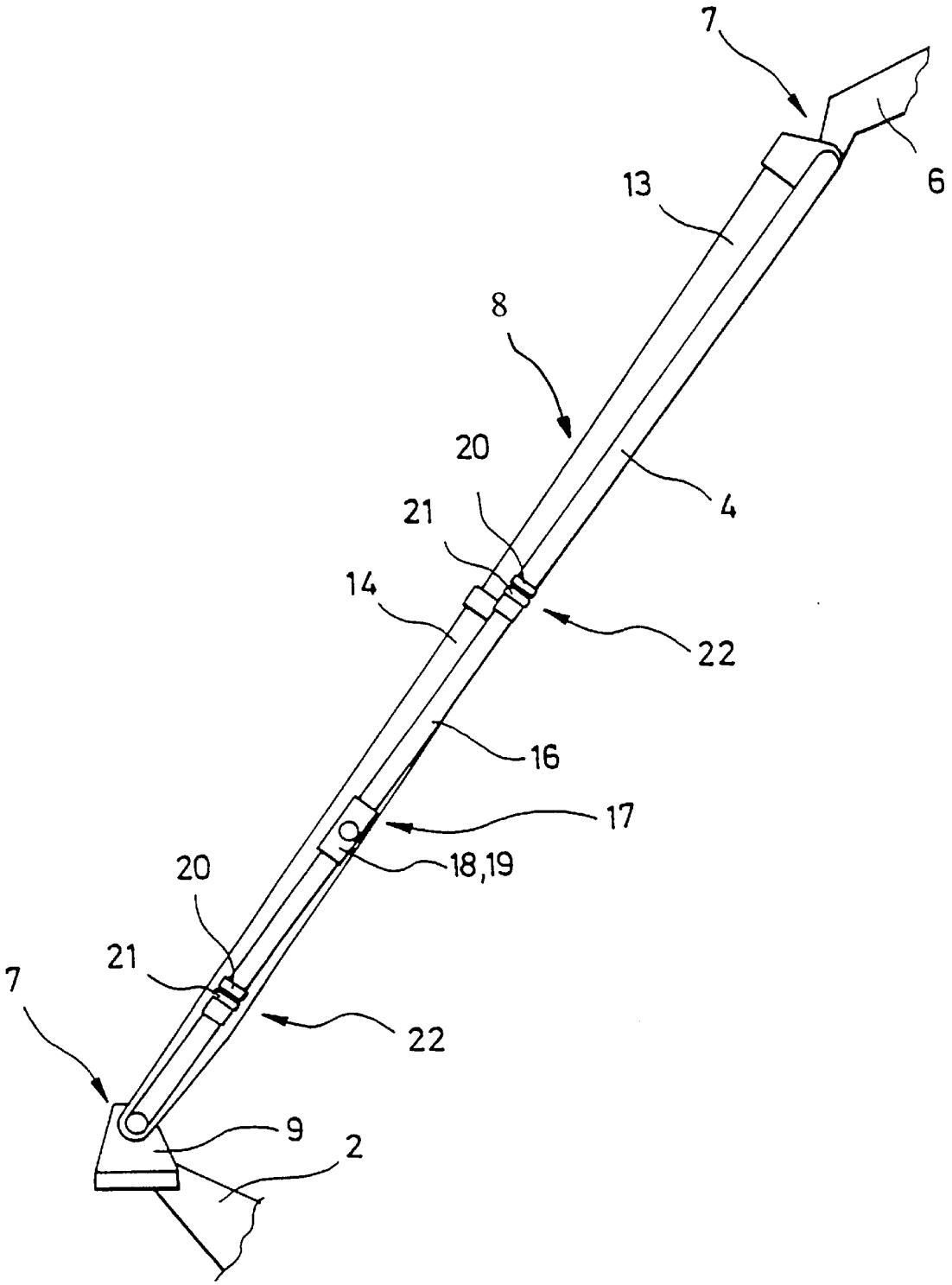
FIG. 8 shows the telescopic supporting arm segment according to FIG. 7 at an extended position.

In the case of the second embodiment of the device 1 according to the present invention, which is shown in FIG. 7 and 8, the auxiliary tubular segment 16 is, in principle, installed in the same way, the only difference being that the auxiliary tubular segment 16 is arranged between the two spaced tubular segments 4 not by means of a pivotal movement, but by means of displacement transversely to the longitudinal direction of the telescopic supporting arm segment 12 and by subsequent tilting about an axis at right angles to the longitudinal direction of said telescopic supporting arm segment 12.

In the case of both embodiments, the first step for demounting the auxiliary tubular segment 16 is that the claw clutches 23, which are defined by the end sections, are opened hydraulically. Subsequently, the telescopic supporting arm segment 12 is returned to its first extended position, whereby the respective end sections 20 and 21 will be separated from one another. The force of spring 19 produces the effect that the end sections 20 and 21 of the auxiliary tubular segment 16 and of the tubular segment 4, which is arranged on the fixed tubular segment 14, are moved to spaced-apart positions. The positioning means 17 can now be returned to its first position at which the auxiliary tubular segment 16 is arranged outside the volume taken up by the tubular segments 4.

The device 1 according to the present invention permits a high lift on the basis of comparatively small dimensions.

I claim:

1. A device for pumping concrete, comprising:

a pump conduit having a conduit end;

a supporting arm operable to position and support said conduit end of said pump conduit, said supporting arm including supporting arm segments which each have arranged thereon at least one tubular segment constituting a component of said pump conduit, wherein at least one of said supporting arm segments is a telescopic supporting arm segment which is movable between at least 1) a non-extended starting position and 2) an extended position in which the length of said telescopic supporting arm segment is longer than the length of the associated tubular arm segment;

an auxiliary tubular segment;

a movable holder which is provided on one of said supporting arm segments and which is coupled to said auxiliary tubular segment, said movable holder being transferable 1) from a first position in which at least one end section of said auxiliary tubular segment is not aligned with at least one end section of one of said tubular segments 2) to a second position at which said at least one end section of said auxiliary tubular segment is in alignment with said at least one end section of said one tubular segment, wherein said tubular segments and said auxiliary tubular segment form portions of said pump conduit.

2. A device according to claim 1, wherein at least two tubular segments have a separation point provided therebetween so that, at the extended position of the telescopic supporting arm segments, the end sections of the associated tubular segments are spaced from one another such that the auxiliary tubular segment can be positioned between said end sections.

3. A device according to claim 1, wherein an end section of the auxiliary tubular segment is always positioned essentially on a common level with an end section of a tubular segment in the axial direction of the associated end section.

4. A device according to claim 1, wherein the movable holder is a pivotable holder.

5. A device according to claim 1, wherein the movable holder is provided on the telescopic supporting arm segment.

6. A device according to claim 1, wherein a longitudinal axis of the auxiliary tubular segment extends essentially parallel to a longitudinal direction of the telescopic supporting arm segment.

7. A device according to claim 4, wherein a pivot axis of the movable holder extends essentially parallel to a longitudinal direction of the telescopic supporting arm segment.

8. A device according to claim 4, wherein a pivot axis of the movable holder extends essentially at right angles to a longitudinal direction of the telescopic supporting arm segment.

9. A device according to claim 2, wherein the end sections of the tubular segments which define the separation point are adapted to be fitted into one another.

10. A device according to claim 1, wherein respective end sections of the tubular segments and of the auxiliary tubular segment are adapted to be fitted into one another.

11. A device according to claim 1, wherein the auxiliary tubular segment is supported in the movable holder so as to be displaced to a limited degree in an axial direction.

12. A device according to claim 1, wherein the movable holder is provided with a spring which pretensions the auxiliary tubular segment in a direction opposite to a telescoping direction when the telescopic supporting segment is being transferred from its non-extended position to its extended position.

13. A device according to claim 12, further comprising a drive which drives the auxiliary tubular segment against the force applied by the spring.

14. A device according to claim 13, further comprising a telescope drive which transfers the telescopic supporting arm segment from its non-extended position to its extended position and back to said non-extended position.

15. A device according to claim 14, wherein the telescope drive constitutes the drive for the auxiliary tubular segment.

16. A device according to claim 2, further comprising a quick-acting coupling which connects together the end sections defining the separation point.

17. A device according to claim 1, further comprising a quick-acting coupling which connects together the end sections of the tubular segments and the associated end sections of the auxiliary tubular segment.

18. A device according to claim 17, wherein the quick-acting coupling comprises a claw clutch, one end section of which is provided with pivotably supported claws which are movable 1) from a closed position at which said claws engage behind a shoulder of the respective other, associated end section, thus interconnecting the two end sections, 2) to an open position at which the claws release said shoulder and the end sections can be separated from one another.

19. A device according to claim 18, wherein the claws are spring-loaded and are pretensioned by a spring at their closed position.

20. A device according to claim 19, wherein the spring-loaded claws are movable from their closed position to their open position with the aid of a fluid.

21. A device according to claim 1, wherein an end face of at least one of said end sections is provided with an annular recess accommodating, in an interengaged condition of the tubular segments, a projection having the shape of a cylindrical ring.

22. A device according to claim 21, wherein the annular recess has arranged therein a sealing element which has the shape of a cylindrical ring and on which the end face of said projection rests in such a way that the two end sections are connected in a liquid-tight manner.

23. A device according to claim 1, wherein the supporting arm segments are articulated on one another via joints.

24. A device according to claim 23, wherein the tubular segments are articulated on one another in the area of said joints.

25. A device according to claim 1, wherein the supporting arm segments are movable to a transport position at which they are arranged essentially parallel to one another.

26. A device according to claim 25, wherein, at said transport position, the supporting arm segments are arranged one on top of the other.

27. A device according to claim 1, wherein several telescopic supporting arm segments and several movable holders are provided.

28. A device according to claim 1, wherein the tubular segments are secured to the associated supporting arm segments.

29. A device according to claim 1, wherein the telescopic supporting arm segment comprises an extendable subsegment and a fixed subsegment, one of said tubular segments being attached to the extendable subsegment which is displaceably received in said fixed subsegment.

30. A device according to claim 1, wherein one of said tubular segments is attached to the fixed subsegment.

31. A device according to claim 1, wherein the device is mounted on a chassis.

32. A device according to claim 1, wherein the device is mounted on a chassis of a truck.

33. A device according to claim 1, wherein the conduit end of the pump conduit is provided with a hoselike extension for distributing the pumped concrete.

34. A device for pumping concrete, comprising:

a chassis;

a pump mounted on said chassis;

a pump conduit having an inlet end connected to said pump and having a conduit end;

a supporting arm which is supported on said chassis and which is operable to support said conduit end and to position said conduit end with respect to said support, said supporting arm including a plurality of supporting arm segments;

a plurality of tubular segments constituting components of said pump conduit, wherein at least one of said tubular segments is supported on each of said supporting arm segments, and wherein at least one of said supporting arm segments is a telescopic supporting arm segment which is movable between at least 1) a non-extended starting position and 2) an extended position in which the length of said telescopic supporting arm segment is longer than the length of the associated tubular arm segment;

an auxiliary tubular segment;

a movable holder which is mounted on said telescopic supporting arm segments and which supports said auxiliary tubular segment, said movable holder being movable, independently of movement of said telescopic supporting arm segment, from 1) from a first position in which said auxiliary tubular segment is parallel with but offset from one of said tubular segments 2) to a second position in which said auxiliary tubular segment is in alignment with said one tubular segment, wherein the tubular segments and the auxiliary tubular segment form portions of said pump conduit.

35. A method of pumping concrete, comprising:

providing a pump conduit having a conduit end;

providing a supporting arm to which said pump conduit is coupled, said supporting arm including supporting arm segments which each have arranged thereon at least one tubular segment, wherein at least one of said supporting arm segments is a telescopic supporting arm segment;

providing a holder on one of said supporting arm segments, said holder having an auxiliary supporting arm segment coupled thereto;

moving said telescopic supporting arm segment between at least 1) a non-extended starting position and 2) an extended position in which the length of said telescopic supporting arm segment is longer than the length of the associated tubular arm segment;

moving said holder from 1) a first position in which at least one end section of said auxiliary tubular segment is not aligned with at least one end section of one of said tubular segments 2) to a second position at which said at least one end section of said auxiliary tubular segment is in alignment with said at least one end section of said one tubular segment; and joining said tubular segments and said auxiliary tubular segment to one another to form portions of said pump conduit.

36. A method according to claim 35, wherein the end sections of the tubular segments and the associated end sections of the auxiliary tubular segment are fitted into one another.

37. A method according to claim 36, wherein, when the end sections of the tubular segments and the associated end sections of the auxiliary tubular segment are fitted into one another, the extended segment is returned from a further extended first telescoped position to a less extended second telescoped position at which the end sections of the tubular segments and the associated end sections of the auxiliary tubular segment are fitted into one another.

* * * * *